US010172427B2

(12) United States Patent
D'Jay

(10) Patent No.: US 10,172,427 B2
(45) Date of Patent: Jan. 8, 2019

(54) SYSTEMS AND METHODS FOR TREKKING POLE WEIGHTS

(71) Applicant: Douglas J. D'Jay, Ridgefield, CT (US)

(72) Inventor: Douglas J. D'Jay, Ridgefield, CT (US)

(73) Assignee: Douglas J. D'Jay, Ridgefield, CT (US)

( * ) Notice: Subject to any disclaimer, the term of this patent is extended or adjusted under 35 U.S.C. 154(b) by 0 days.

(21) Appl. No.: 15/720,217

(22) Filed: Sep. 29, 2017

(65) Prior Publication Data

US 2018/0177268 A1 Jun. 28, 2018

Related U.S. Application Data

(63) Continuation of application No. 15/480,680, filed on Apr. 6, 2017.

(60) Provisional application No. 62/439,457, filed on Dec. 27, 2016.

(51) Int. Cl.

| | |
|---|---|
| ***A45B 3/00*** | (2006.01) |
| ***A45B 9/02*** | (2006.01) |
| ***A45B 9/04*** | (2006.01) |
| ***B65D 25/40*** | (2006.01) |
| ***B65D 23/00*** | (2006.01) |
| *A45B 9/00* | (2006.01) |

(52) U.S. Cl.

CPC ..... *A45B 9/02* (2013.01); *A45B 3/00* (2013.01); *A45B 9/04* (2013.01); *B65D 23/001* (2013.01); *B65D 25/40* (2013.01); *A45B 2009/002* (2013.01); *A45B 2009/005* (2013.01); *A45B 2009/007* (2013.01); *A45B 2200/055* (2013.01)

(58) Field of Classification Search

CPC ..... A45B 3/00; A63B 15/00; A63B 21/072

USPC ..... 135/76, 65; 482/74, 93, 109

See application file for complete search history.

(56) References Cited

U.S. PATENT DOCUMENTS

| | | | | | |
|---|---|---|---|---|---|
| 4,664,373 | A * | 5/1987 | Hait | A63B 21/0603 | 482/109 |
| 4,688,788 | A * | 8/1987 | Olufs | A63B 15/00 | 482/109 |
| 4,756,524 | A * | 7/1988 | Cooney | A63B 15/00 | 135/75 |
| 5,443,435 | A * | 8/1995 | Wilkinson | A45B 3/00 | 482/109 |
| 5,778,914 | A * | 7/1998 | Trani | A45B 3/00 | 135/66 |
| 5,788,608 | A * | 8/1998 | Wilkinson | A63B 21/0724 | 482/51 |
| 5,876,312 | A * | 3/1999 | McClendon | A63B 15/00 | 482/106 |
| 6,085,766 | A * | 7/2000 | Geary | A01B 1/00 | 135/68 |

(Continued)

FOREIGN PATENT DOCUMENTS

WO WO-2017190014 A1 * 11/2017 ..... A61H 3/0288

*Primary Examiner* — Noah Chandler Hawk

(74) *Attorney, Agent, or Firm* — Carson C. K. Fincham; Fincham Downs LLC

(57) ABSTRACT

Systems, methods, and articles of manufacture for multi-segment weighted trekking poles are provided. A typical three-segment trekking (or other) pole may benefit from removable annular-shaped weights that may provide liquid storage and may be retained in position by one or more weight locks. The standard basket and tip protector may be replaced with a combined tip protector and basket element that threads onto a bottom segment of the pole.

7 Claims, 7 Drawing Sheets

(56) References Cited

U.S. PATENT DOCUMENTS

| | | | | |
|---|---|---|---|---|
| 7,708,671 | B2 * | 5/2010 | Burkhardt | A63B 21/026<br>482/106 |
| 8,500,609 | B1 * | 8/2013 | Williams | A63C 11/228<br>135/65 |
| 2003/0145881 | A1 * | 8/2003 | Harroun | A61H 3/00<br>135/65 |
| 2009/0159106 | A1 * | 6/2009 | Schulz | A45B 9/02<br>135/75 |
| 2010/0051077 | A1 * | 3/2010 | McGann | A45B 9/02<br>135/76 |

* cited by examiner

SYSTEMS AND METHODS FOR TREKKING POLE WEIGHTS

CROSS-REFERENCE TO RELATED APPLICATIONS

The present application is a Continuation-in-Part (CiP) of, and claims benefit and priority to, U.S. Non-provisional patent application Ser. No. 15/480,680 filed Apr. 6, 2017 and titled "MULTI-SEGMENT MID-WEIGHTED TREKKING POLE", which itself is a non-provisional of, and claims benefit and priority under 35 U.S.C. § 119(e) to, U.S. Provisional Patent Application No. 62/439,457 filed on Dec. 27, 2016 and titled "Adjustable weight middle and bottom replacement segments for three-segment carbon-fiber trekking poles", the entirety of each of which is hereby incorporated by reference herein.

BACKGROUND

Various types of hand-held canes, staffs, sticks, and poles are utilized for various purposes. While their usage dates back millennia, modern usages are typical in various sports and activities such as skiing, walking, and hiking (or trekking, running, etc.). As many of these activities are centered on physical fitness, there have been a wide variety of efforts to increase the effectiveness of hand-held poles as workout tools by adding weights thereto.

In U.S. Pat. No. 5,443,435 to Wilkinson, for example, weighted portions are added to either the bottom or handle of an adjustable-length exercise/sport pole to increase arm exercise functionality thereof. Similarly, in British Patent Application No. GB2490168A to Robinson, donut or disk-shaped weights are mounted to the bottom or top of an adjustable-length Nordic walking pole to achieve the same benefit. In U.S. Pat. No. 5,876,312 to McClendon, interior weights (steel balls) are similarly added to top or bottom portions of a multi-segment walking stick, in U.S. Patent Application Publication No. 2003/0145881 to Harroun weights are added to the bottom (interior) of an adjustable height therapeutic cane, and in U.S. Pat. No. 8,500,609 to Williams an attachable weight assembly for a pole is disclosed.

These and other attempts at providing weighted poles, while offering certain advantages, suffer from various deficiencies.

BRIEF DESCRIPTION OF THE DRAWINGS

An understanding of embodiments described herein and many of the attendant advantages thereof may be readily obtained by reference to the following detailed description when considered with the accompanying drawings, wherein.

DETAILED DESCRIPTION

I. Introduction

Embodiments presented herein are descriptive of systems, apparatus, methods, and articles of manufacture for multi-segment weighted trekking poles (and/or portions thereof). In some embodiments, a typical three-segment adjustable trekking pole may be provided with exterior-mounted weights secured by a locking mechanism. According to some embodiments, the exterior-mounted weights and attendant locking mechanism(s) may be coupled to either or both of a middle segment or a lower segment of a multi-segment trekking pole. In such a manner, for example, standard three-segment trekking (or other) poles may be quickly and easily adapted to add mid-mounted and/or lower-mounted weights that enhances the workout functionality of the poles. In some embodiments, the weights may comprise liquid bladders, bottles, and/or other storage vessels. In such a manner, for example, the additional weight carried by the pole may be useful, such as for hydration of a hiker, runner, or walker exercising with the weighted-pole.

Typical multi-segment, adjustable length trekking poles are designed to be light-weight and offer ground-engaging stability, particularly in trail hiking or off-road uses. They also offer some physical fitness benefits be promoting arm and upper-body movement that, e.g., may be lacking in standard walking or other lower-body engaging exercise activities. Previous attempts at adding weight to enhance the upper-body workout benefits of utilizing such poles have offered some advantages but remain deficient. Most previous attempts, for example, require specially-designed or configured poles that are customized to accept specific types of added weights.

Embodiments for multi-segment weighted trekking poles presented herein solve these and other deficiencies of previous weighted pole designs. Embodiments herein provide for mid-weighted or lower-weighted poles, for example, that are capable of being weighted utilizing universal slide-on weights that are secured in place via one or more locking mechanisms. In such a manner, for example, standard or pre-existing poles may be retrofitted with variable weights without placing undue strain on pole components. These and other attendant advantages are readily perceived in light of the detailed description of the embodiments presented herein.

II. Typical Three-Segment Trekking Pole

Figure 1:
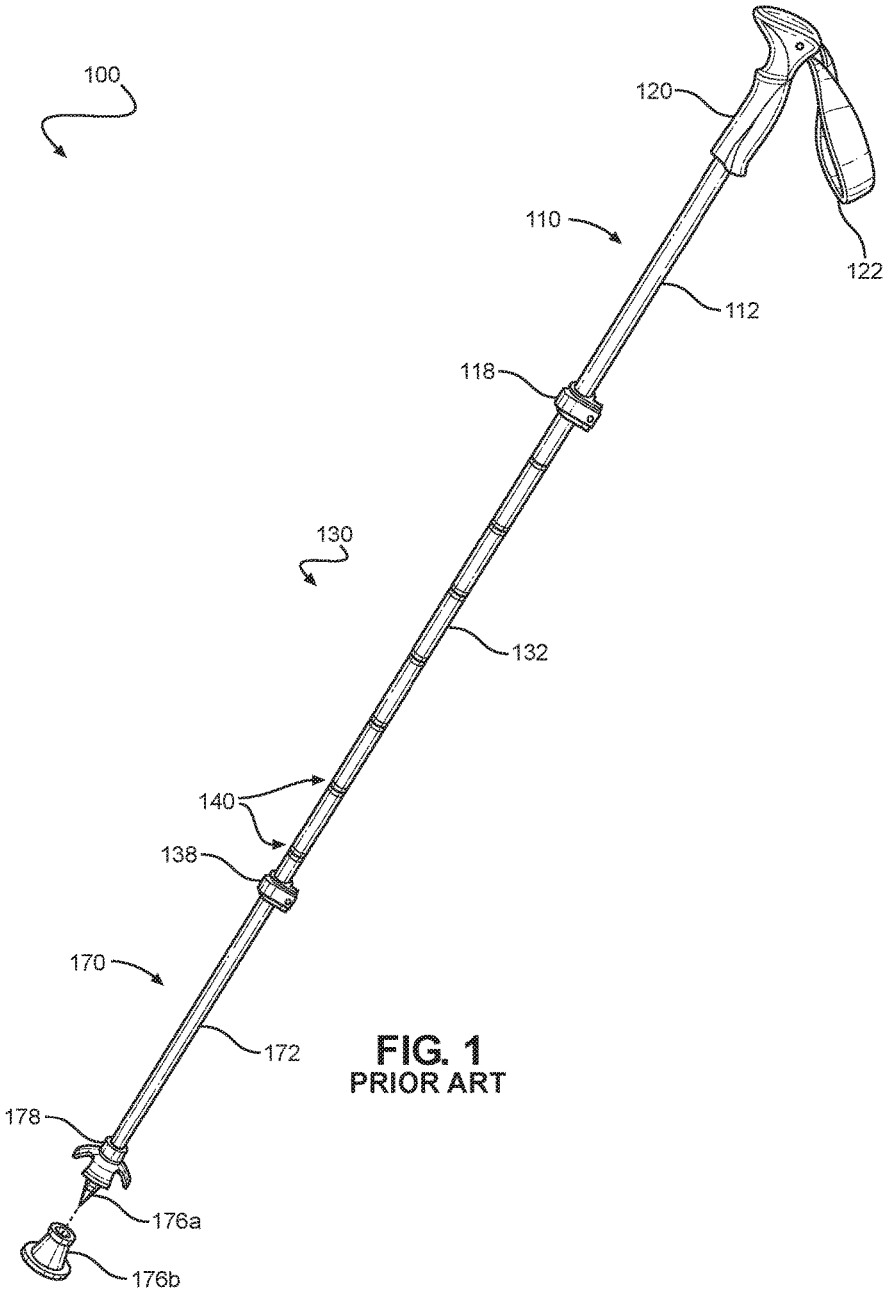
FIG. 1 PRIOR ART
FIG. 1 is a left-front perspective view of a prior art multi-segment trekking pole.

Turning initially to FIG. 1, a left-front perspective view of a prior art multi-segment trekking pole 100 is shown. The standard trekking pole 100 may, for example, comprise a handle segment 110 comprising an upper shaft 112 and an upper locking mechanism 118. The handle segment 110 often comprises a handle 120 disposed at a first or upper end of the upper shaft 112 and may include a wrist strap 122, e.g., attached to the handle 120. In the case that the multi-segment trekking pole 100 comprises a three-segment pole, it may comprise a center or middle segment 130. The middle segment 130 may, for example, couple to the handle segment 110 via the upper locking mechanism 118. The middle segment 130 may comprise a middle shaft 132, for example, that engages with the handle segment 110. A first or upper end or portion of the middle shaft 132 and/or the middle segment 130 may, for example, mate with the handle segment 110 and/or the upper locking mechanism 118. In some cases, the middle segment 130 may have an outer diameter (e.g., "male" portion) that is smaller than an inner diameter (e.g., "female" portion) of the handle segment 110 and may nest within the handle segment 110. In such cases, the upper locking mechanism 118 may be selectively engaged to lock the middle segment 130 at whatever extent of insertion into the handle segment 110 it is currently situated in. In such a manner, the pole 100 may be extendible and/or collapsible.

In some cases, the middle segment 130 may comprise a lower locking mechanism 138 and/or may be marked (e.g., along the middle shaft 132) with a plurality of measurement indicators 140. The lower locking mechanism 138 may accept and/or couple to a lower segment 170. The lower segment 170 may comprise a lower shaft 172, for example, that engages with the middle segment 130. A first or upper end or portion of the lower shaft 172 and/or the lower segment 170 may, for example, mate with the middle segment 130 and/or the lower locking mechanism 138. In some cases, the lower segment 170 may have an outer diameter (e.g., "male" portion) that is smaller than an inner diameter (e.g., "female" portion) of the middle segment 130 and may nest within the middle segment 130. In such cases, the lower locking mechanism 138 may be selectively engaged to lock the lower segment 170 at whatever extent of insertion into the middle segment 130 it is currently situated in. In such a manner, the pole 100 may be extendible and/or collapsible such that each "male" shaft 172, 132 may nest within each respective "female" shaft 132, 112, such as to allow for easy transport of the pole 100.

The measurement indicators 140 may generally allow a user to readily perceive how far into the "female" handle" segment 110 the middle shaft 132 (and/or middle segment 130) is inserted, such as to easily identify and replicate a desired extension distance subsequent to the pole 100 being collapsed, e.g., for travel. In some cases, the measurement indicators 140 may allow the user to readily perceive a currently-selected length of the pole 100, such as per desired exercise and/or other guidelines or requirements. In some cases, the lower segment 170 and/or the lower shaft 172 may comprise one or more ground-engaging elements 176*a-b*. Trekking and ski poles typically comprise, for example, a pointed tip 176*a* such as a tungsten carbide tip for embedding within engaged ground to promote traction and stability. In some cases, such as either for travel protection or for engagement of hard surfaces such as roads and sidewalks, the lower segment 170 and/or the lower shaft 172 may comprise a foot or tip protector 176*b*. The pointed tip 176*a* may generally, for example, removably couple to the tip protector 176*b* via an interference fit, as desired. In some cases, the lower segment 170 and/or the lower shaft 172 may comprise a "basket" 178. The basket 178 may, for example, reduce penetration into and/or provide greater traction or stability in soft ground media such as sand and snow. In some cases, the handle 120, the wrist strap 122, the ground-engaging elements 176*a-b*, and/or the basket 178 may be removable and/or interchangeable with different versions of accessories, e.g., available from the manufacturer of the pole 100. The various shafts 112, 132, 172 of the pole 100 may generally be constructed of aluminum or carbon-fiber (e.g., carbon-composite) to provide for a light-weight pole 100 while maintaining structural sturdiness.

III. Multi-Segment Weighted Trekking Pole Systems

Figure 2A:
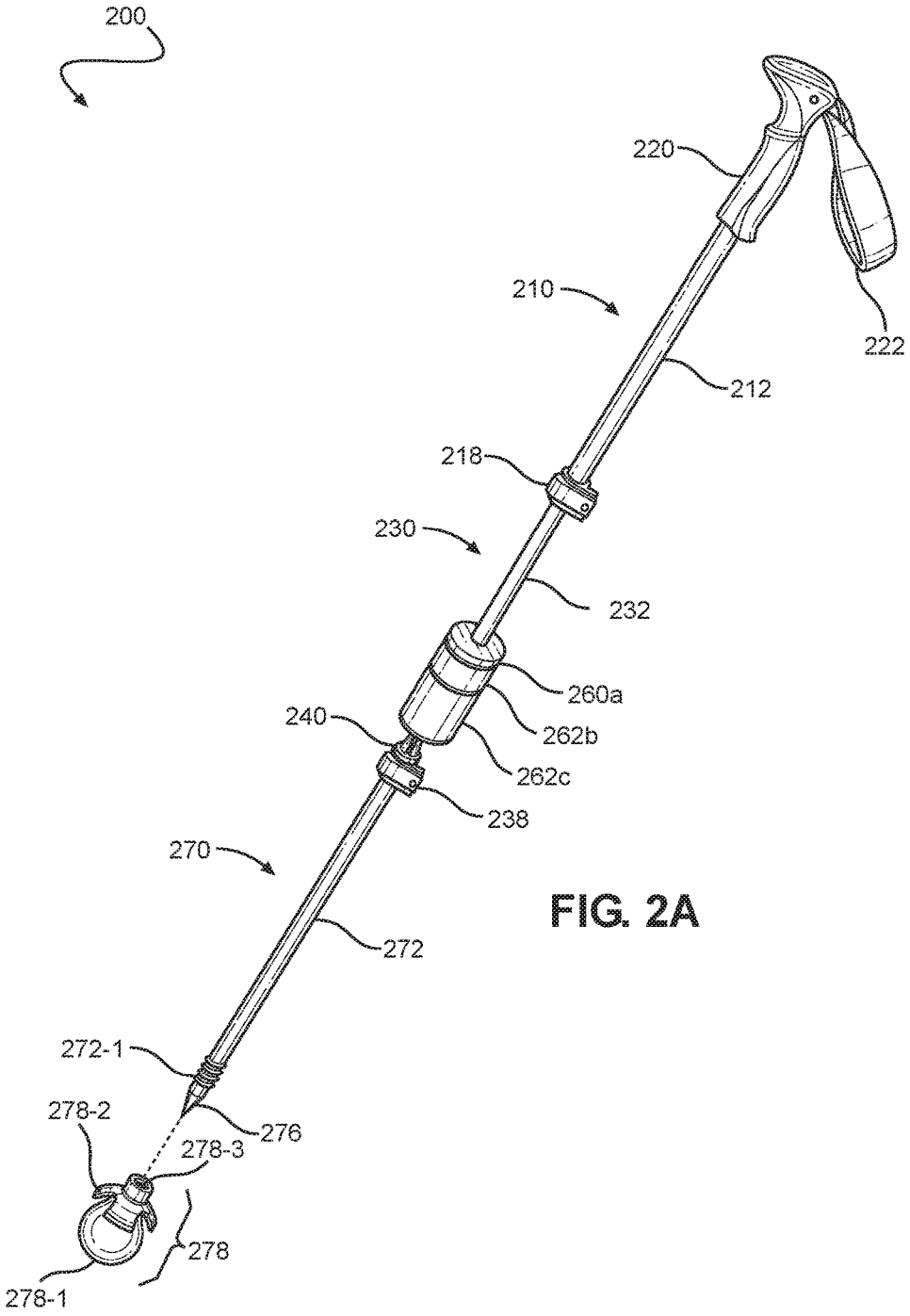
FIG. 2A and FIG. 2B are left-front perspective and front assembly views of a multi-segment weighted trekking pole system according to some embodiments.
Figure 2B:
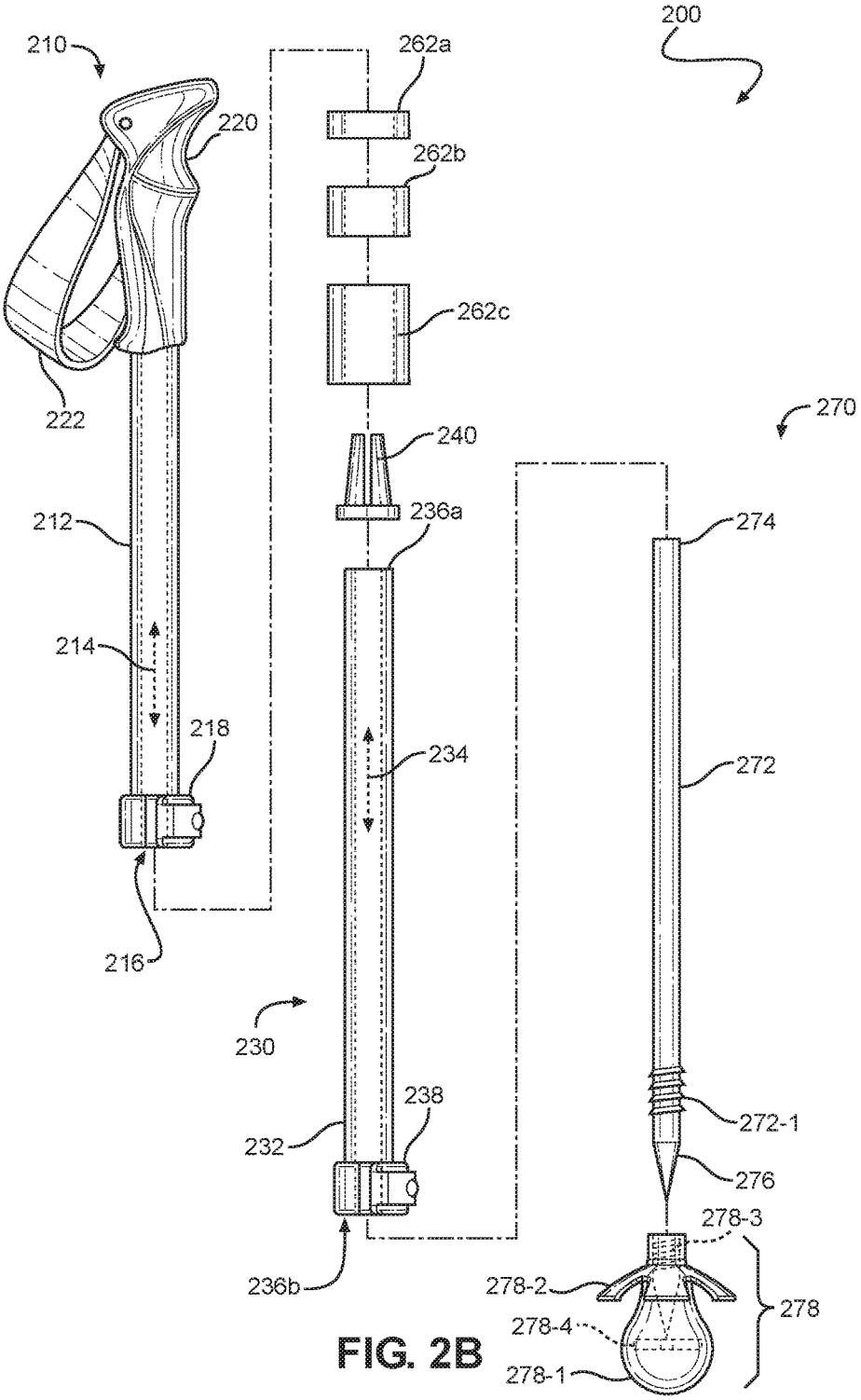

Referring now to FIG. 2A and FIG. 2B, left-front perspective and front assembly views of a multi-segment weighted trekking pole system 200 according to some embodiments are shown. In some embodiments, the trekking pole 200 may comprise a first, upper, or handle segment 210. The handle segment 210 may comprise, for example a first or upper shaft 212 such as a hollow carbon-fiber or aluminum tube. The upper shaft 212 may, for example, define an upper interior passage 214 extending lengthwise or axially within the upper shaft 212 and/or handle portion 210. According to some embodiments, a first or bottom end of the upper shaft 212 and/or the handle portion 210 may define and/or comprise a first or upper opening 216 (e.g., a first "female" opening) into the upper interior passage 214. In some embodiments, a first or upper locking mechanism 218 may be coupled to the upper shaft 212 at or adjacent to the upper opening 216. The upper locking mechanism 218 may, for example, be operable to be selectively engaged to compress and/or otherwise secure or fix the bottom end and/or the upper opening 216. According to some embodiments, the upper shaft 212 and/or the handle portion 210 may comprise, at a second or top end thereof, a handle 220 and/or a wrist strap 222. The handle 220 may comprise, for example, a molded, formed, and/or shaped element made of various desirable handle materials such as rubber, wood (e.g., cork), foam, etc. The wrist strap 222 may comprise a strip of rubber, fabric, cloth, and/or a lanyard coupled to the handle 220 and/or forming a loop via which, e.g., a user (not shown) may engage their wrist while holding the handle 220.

According to some embodiments, the multi-segment weighted trekking pole system 200 may comprise a middle portion 230. In some embodiments, the middle portion 230 may comprise a middle shaft 232 that defines a middle interior passage 234 extending lengthwise or axially within the middle shaft 232. In some embodiments, the middle shaft 232 may be constructed of aluminum or carbon-fiber and/or may be approximately twenty-two inches (22") or fifty-five and eighty-eight hundredths centimeters (55.88 cm) in length. According to some embodiments, a first or top end of the middle shaft 232 may define and/or comprise a first or upper-middle end or opening 236*a* (e.g., a first "male" end—even though the first end 236*a* may be open to the middle interior passage 234). In some embodiments, a second or bottom end of the middle shaft 232 may define and/or comprise a second or lower-middle opening 236*b* (e.g., a second "female" end or opening) into the middle interior passage 234. According to some embodiments, a lower-middle locking mechanism 238 may be coupled to the middle shaft 232 at or adjacent to the lower-middle opening 236*b*. The lower-middle locking mechanism 238 may, for example, be operable to be selectively engaged to compress and/or otherwise secure or fix the second or bottom end of the middle shaft 232 and/or the second or lower-middle opening 236*b*.

In some embodiments, the middle portion 230 may comprise a weight lock 240 and/or a plurality of weights 262*a-c*. The weight lock 240 and the weights 262*a-c* may, for example, comprise annular elements that slide onto the middle shaft 232. The weight lock 240 may, in some embodiments, comprise a metal, rubber, and/or plastic element having a taper that nests inside of a bottom or third one of the weights 262*c*. According to some embodiments, the tapered and/or weight-engaging portion of the weight lock 240 (e.g., a portion that slides into the bore of the third weight 262*c*) may be pliable such that the third weight 262*c* resting thereupon, in the case that the weight lock 240 is sleeved over the middle shaft 232, may urge or squeeze the pliable tapered portion inward, increasing inward radial force applied by the weight lock 240 on the sides of the middle shaft 232. The weights 262*a-c* acting upon the weight lock 240 may, for example, cause the weight lock 240 to squeeze the middle shaft 232, e.g., causing an engagement that prevents the weight lock 240 (and the attendant weights 262*a-c*) from sliding down the middle shaft 232. In such a manner, for example, the weight lock 240 may support the weights 262*a-c* and prevent the weights 262*a-c* from exerting undue force upon the lower-middle locking mechanism 238. In some embodiments, an additional weight lock (not shown) may be coupled above the weights 262*a-c*, such as to prevent upward movement of the weights 262*a-c* during use and/or transport of the multi-segment weighted trekking pole system 200.

According to some embodiments, the weights 262*a-c* may comprise cylindrical metal elements having internal bores through which the outside diameter of the middle shaft 232 may freely pass. According to some embodiments, the weights 262*a-c* may be constructed of cast iron and/or may be covered or coated with one or more protective layers such as a rubberized coating, a neoprene sleeve, etc. The weights 262*a-c* may comprise equal diameters but differing thicknesses, such that each weight 262*a-c*, in some embodiments, weighs one of: (i) one pound (1 lb) or forty-five hundredths of a kilogram (0.45 kg), (ii) two pounds (2 lb) or ninety-one hundredths of a kilogram (0.91 kg), or (iii) five pounds (5 lb) or two and twenty-seven hundredths kilograms (2.27 kg). In the non-limiting example case of the three (3) weights 262*a-c* being utilized as depicted in FIG. 2A and FIG. 2B, approximately eight pounds (8 lb) or three and sixty-three hundredths kilograms (3.63 kg) of weight/mass may be retained by the weight lock 240 and/or by the middle shaft 232 (e.g., a first weight 262*a* may weigh one pound (1 lb) or forty-five hundredths of a kilogram (0.45 kg), a second weight 262*b* may weigh two pounds (2 lb) or ninety-one hundredths of a kilogram (0.91 kg), and/or the third weight 262*c* may weigh five pounds (5 lb) or two and twenty-seven hundredths kilograms (2.27 kg)).

In some embodiments, additional weights (not shown) may be utilized until at least approximately three inches (3") or seven and sixty-two hundredths centimeters (7.62 cm) of the first end 236*a* of the middle shaft 232 remains extending above/beyond the mounted weights 262*a-c* (and/or additional upper weight lock), e.g., to provide for at least three inches (3") or seven and sixty-two hundredths centimeters (7.62 cm) of "male" insertion distance into the upper interior passage 214 of the upper shaft 212, such as to permit an adequately strong coupling of the handle portion 210 and the middle portion 230. According to some embodiments, one or more of the weights 262*a-c* may comprise hollow annular cylinders defining internal volumes (not depicted in FIG. 2A or FIG. 2B; e.g., the weights 362*a-b* of FIG. 3A and FIG. 3B and/or the weights 562, 662, 762 of FIG. 5, FIG. 6, and/or FIG. 7 herein) filled with various desirable weight-bearing substances. The weights 262*a-c* may be filled with sand, concrete, rocks, and/or other solid or granular substances, for example, and/or may be filled with water, glycol, and/or other liquids. The weights 262*a-c* may, for example, comprise one or more water bottles having a hole or passage (not shown) that permits the water bottle-weight to be slid onto the middle shaft 232. According to some embodiments, the weights 262*a-c* may comprise a valve, nipple, spout, and/or other feature (not shown) that permits substances disposed within any interior void to be added or removed therefrom, as desired.

In some embodiments, the multi-segment weighted trekking pole system 200 may comprise a lower segment 270. The lower segment 270 may comprise, for example a lower shaft 272 that may comprise a solid (or hollow) carbon-fiber, aluminum, or steel rod. In some embodiments, the lower shaft 272 and/or the lower segment 270 may comprise a first or lower "male" end 274 at a top end thereof and/or one or more engaging elements 276, 278 at a bottom end thereof. A first engaging element 276 may comprise, for example, a ground-engaging tip such as a tungsten carbide tip for engaging with ground elements such as dirt, rocks, tree roots, etc. According to some embodiments, a second engaging element 278 may comprise a combined blunt tip and basket unit. The second engaging element 278 may, for example, comprise a plastic, rubber, and/or metal foot element 278-1 for engaging with hard surfaces such as floors, sidewalks, roads, etc. According to some embodiments, the foot element 278-1 may comprise and/or house a steel disk or insert (not shown) to prevent the tip 276 from puncturing through the softer material of the foot element 278-1. In some embodiments, the second engaging element 278 may comprise a basket element 278-2. The basket element 278-2 may comprise, for example, a plastic or metal radially flared element for enhancing stability and/or reducing penetration distance into soft materials such as sand or snow. In some embodiments, the basket element 278-2 and foot element 278-1 (e.g., the second engaging element 278) may comprise and/or define a cavity for accepting the tip 276 (e.g., a cavity in which the metal protective disk is disposed). In some embodiments, internal threads 278-3 may be disposed within the cavity and may be operable to be engaged with exterior threads 272-1 of the lower shaft 272 to removably couple the second engaging element 278 to the lower shaft 272.

According to some embodiments, the assembly of the multi-segment weighted trekking pole system 200 may be as depicted in FIG. 2B. The lower male end 274 of the lower shaft 272 may define and/or comprise an outside diameter that is smaller than an inside diameter of the middle interior passage 234 of the middle shaft 232, for example, and may be inserted into and/or nested therein (e.g., by at least three inches (3") or seven and sixty-two hundredths centimeters (7.62 cm) of "male" insertion distance, such as to permit an adequately strong coupling and/or to reduce the strain placed on the lower shaft 272). The lower male end 274 may be inserted into the lower-middle opening 236*b* of the middle shaft 232, in some embodiments, and selectively secured in place at a desired level of insertion by engagement and/or activation of the lower-middle locking mechanism 238. Similarly, the first end 236*a* of the middle shaft 232 may define and/or comprise an outside diameter that is smaller than the inside diameter of the upper interior passage 214 of the upper shaft 212 and may be inserted into and/or nested therein. The first end 236*a* may be inserted into the upper opening 216 of the upper shaft 212, for example, and selectively secured in place at a desired level of insertion (e.g., by at least three inches (3") or seven and sixty-two hundredths centimeters (7.62 cm), such as to permit an adequately strong coupling and/or to reduce the strain placed on the middle shaft 232) by engagement and/or activation of the upper locking mechanism 218. According to some embodiments, the lower male end 274 and/or the first end 236*a* may comprise and/or be coupled to an end protector (not shown) such as a plastic or rubber tip, e.g., to reduce and/or prevent damage (e.g., chipping) from abutment or collision of the lower male end 274 with the lower-middle opening 236*b* (e.g., within the middle interior passage 234) and/or to reduce and/or prevent damage (e.g., chipping) from abutment or collision of the first end 236*a* with the upper opening 216 (e.g., within the upper interior passage 214).

In some embodiments, any desired quantity and/or mass or size of weights 262*a-c* and/or the weight lock 240 may be inserted onto the middle shaft 232, e.g., from the first end 236*a* thereof. In such a manner, for example, the multi-segment weighted trekking pole system 200 may be outfitted with a variable amount of weight (e.g., the weights 262*a-c*) between the handle segment 210 and the lower segment 270, permitting not only enhanced fitness capabilities that are less likely to result in injury (e.g., wrist straining and/or loss of balance) but also providing for quick and easy change-over to different weight levels and/or to a standard trekking pole configuration, as desired. According to some embodiments, such as described in more detail with respect to FIG. 3A and FIG. 3B herein, the weights 262*a-c* and/or the weight lock 240 may also or alternatively be utilized on the lower shaft 272.

The multi-segment weighted trekking pole system 200 is described as a "trekking pole" for purposes of illustration and ease of description. While in some embodiments the multi-segment weighted trekking pole system 200 may be constructed and/or utilized for hiking, trekking, walking, and/or "Nordic-style" walking (and/or running), the multi-segment weighted trekking pole system 200 may also or alternatively be constructed and/or utilized for skiing, exercising, and/or other activities that are or become practicable. While one style of clamp is depicted with respect to the locking mechanisms 218, 238, different types and/or styles of locking mechanisms 218, 238 may be utilized in some embodiments, as is or becomes known or practicable. According to some embodiments, larger locking mechanisms 218, 238 and/or additional (e.g., paired) locking mechanisms 218, 238 may be utilized, e.g., to maintain retention and/or coupling abilities under additional strain placed on the multi-segment weighted trekking pole system 200 and/or between the segments 210, 230, 270 thereof due to the added weights 262*a-c*.

In some embodiments, any or all of the components 210, 212, 214, 216, 218, 220, 222, 230, 232, 234, 236*a-b*, 238, 240, 262*a-c*, 270, 272, 272-1, 274, 276, 278, 278-1, 278-2, 278-3 of the multi-segment weighted trekking pole system 200 may be similar in configuration and/or functionality to any similarly named and/or numbered components described herein. Fewer or more components 210, 212, 214, 216, 218, 220, 222, 230, 232, 234, 236*a-b*, 238, 240, 262*a-c*, 270, 272, 272-1, 274, 276, 278, 278-1, 278-2, 278-3 (and/or portions thereof) and/or various configurations of the components 210, 212, 214, 216, 218, 220, 222, 230, 232, 234, 236*a-b*, 238, 240, 262*a-c*, 270, 272, 272-1, 274, 276, 278, 278-1, 278-2, 278-3 may be included in the multi-segment weighted trekking pole system 200 without deviating from the scope of embodiments described herein. In some embodiments, one or more of the various components 210, 212, 214, 216, 218, 220, 222, 230, 232, 234, 236*a-b*, 238, 240, 262*a-c*, 270, 272, 272-1, 274, 276, 278, 278-1, 278-2, 278-3 may not be needed and/or desired in the multi-segment weighted trekking pole system 200.

Figure 3A:
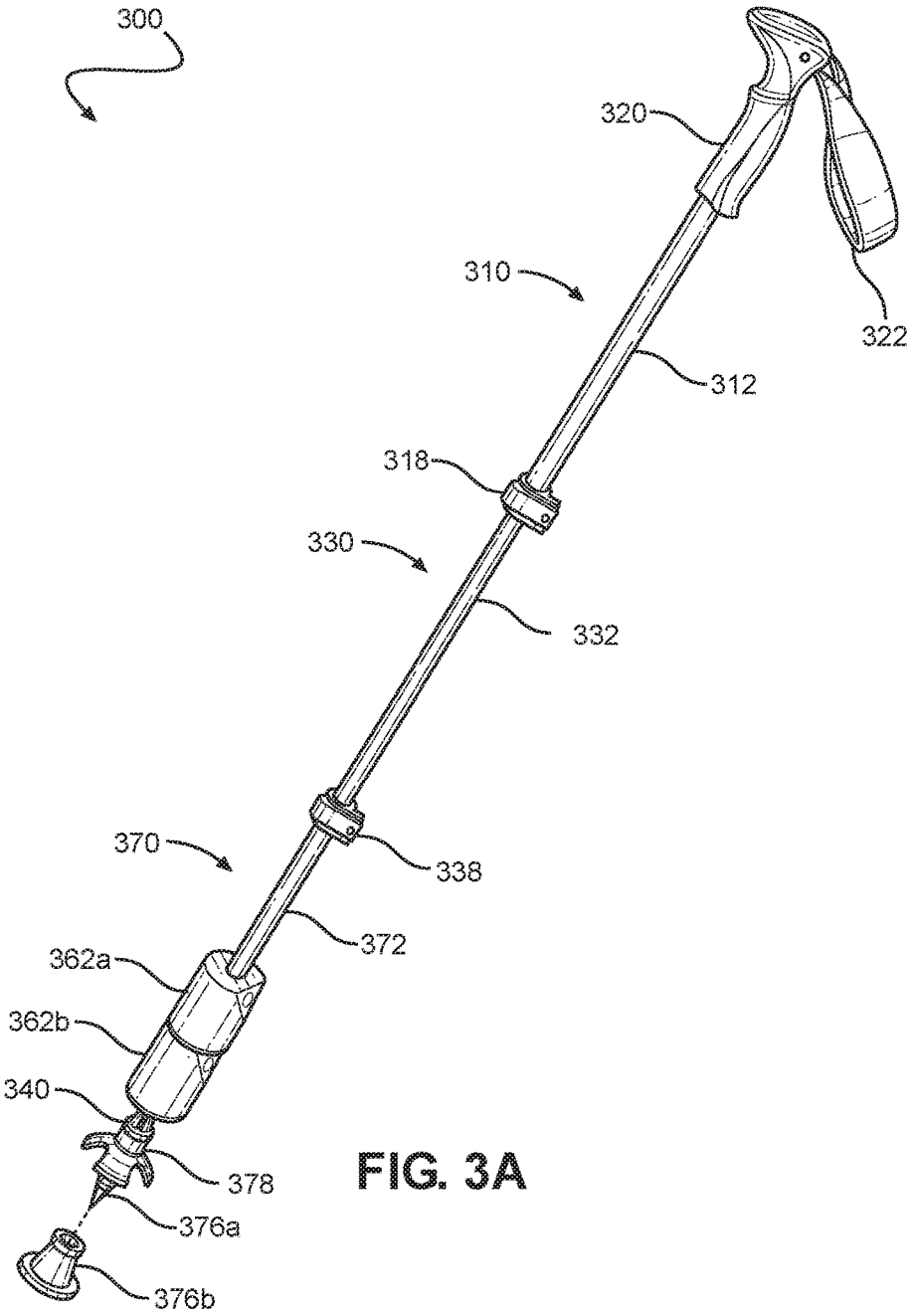
FIG. 3A and FIG. 3B are left-front perspective and front assembly views of a multi-segment weighted trekking pole system according to some embodiments.
Figure 3B:
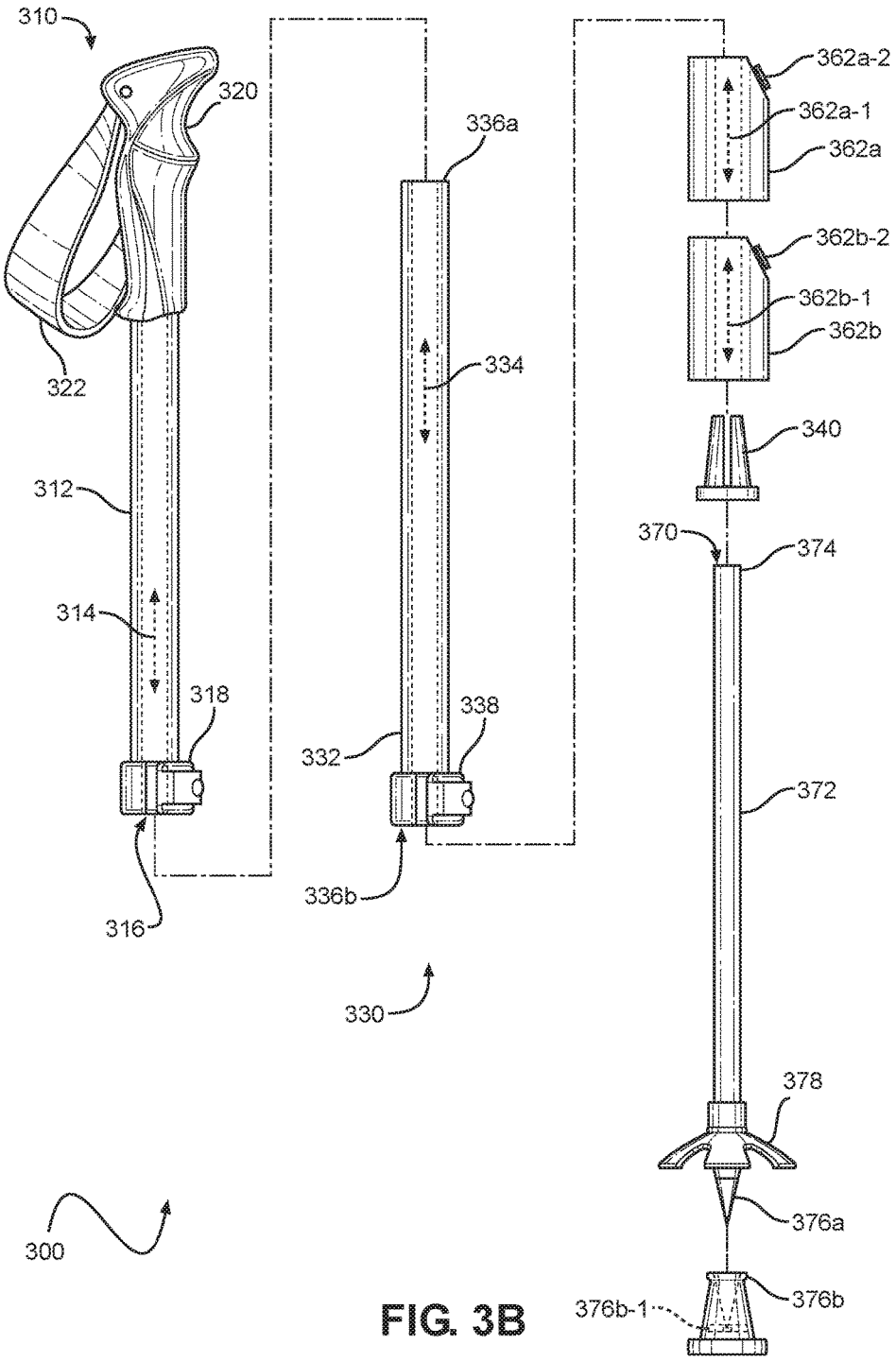
Figure 4A:
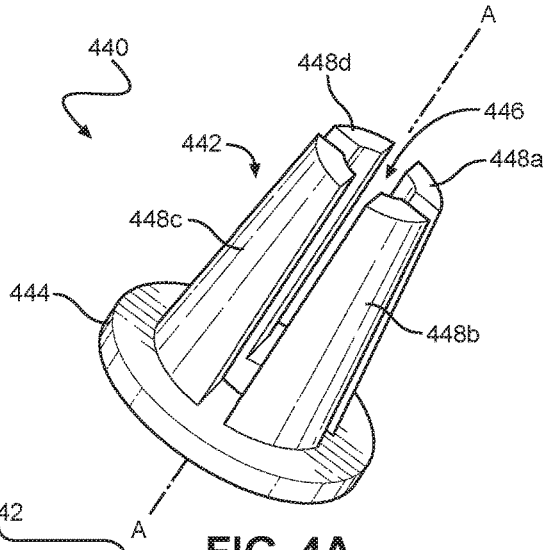
FIG. 4A, FIG. 4B, FIG. 4C, and FIG. 4D are left-front perspective, top, bottom, and front views of a weight lock according to some embodiments.
Figure 4B:
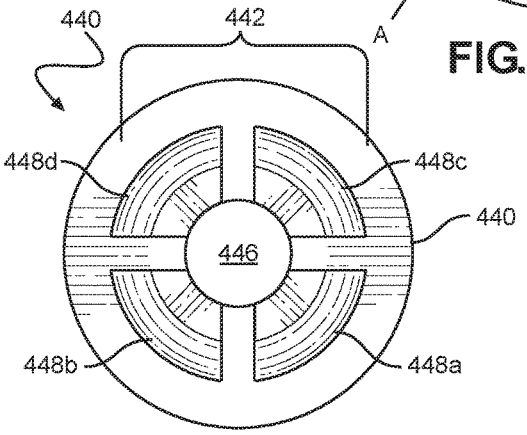
Figure 4C:
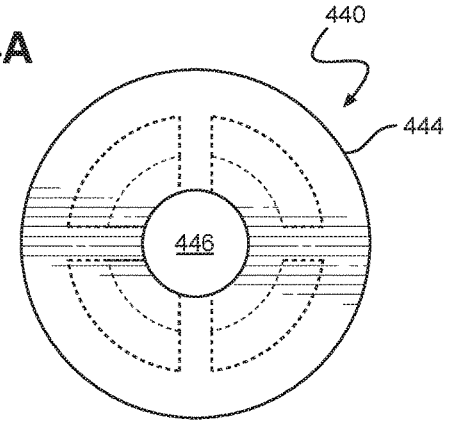
Figure 4D:
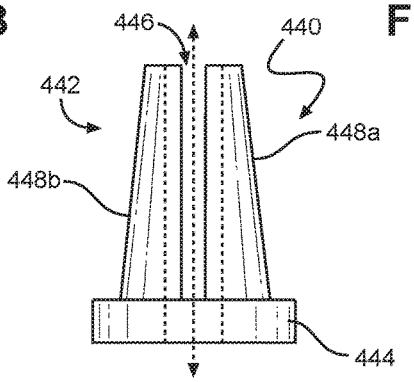

Turning to FIG. 3A and FIG. 3B, left-front perspective and front assembly views of a multi-segment weighted trekking pole system 300 according to some embodiments are shown. In some embodiments, the multi-segment weighted trekking pole system 300 may comprise a first, upper, or handle segment 310. The handle segment 310 may comprise, for example a first or upper shaft 312 such as a hollow carbon-fiber or aluminum tube. The upper shaft 312 may, for example, define an interior passage 314 extending lengthwise or axially within the upper shaft 312 and/or handle portion 310. According to some embodiments, a first or bottom end of the upper shaft 312 and/or the handle portion 310 may define and/or comprise a first or upper opening 316 (e.g., a first "female" opening) into the interior passage 314. In some embodiments, a first or upper locking mechanism 318 may be coupled to the upper shaft 312 at or adjacent to the upper opening 316. The upper locking mechanism 318 may, for example, be operable to be selectively engaged to compress and/or otherwise secure or fix the bottom end and/or the upper opening 316. According to some embodiments, the upper shaft 312 and/or the handle portion 310 may comprise, at a second or top end thereof, a handle 320 and/or a wrist strap 322. The handle 320 may comprise, for example, a molded, formed, and/or shaped element made of various desirable handle materials such as rubber, wood (e.g., cork), foam, etc. The wrist strap 322 may comprise a strip of rubber, fabric, cloth, and/or a lanyard coupled to the handle 320 and/or forming a loop via which, e.g., a user (not shown) may engage their wrist while holding the handle 320.

According to some embodiments, the multi-segment weighted trekking pole system 300 may comprise a middle portion 330. In some embodiments, the middle portion 330 may comprise a middle shaft 332 that defines a middle interior passage 334 extending lengthwise or axially within the middle shaft 332. In some embodiments, the middle shaft 332 may be constructed of aluminum or carbon-fiber and/or may be approximately twenty-two inches (22") or fifty-five and eighty-eight hundredths centimeters (55.88 cm) in length. According to some embodiments, a first or top end of the middle shaft 332 may define and/or comprise a first or upper-middle end or opening 336*a* (e.g., a first "male" end—even though the first end 336*a* may be open to the middle interior passage 334). In some embodiments, a second or bottom end of the middle shaft 332 may define and/or comprise a second or lower-middle opening 336*b* (e.g., a second "female" end or opening) into the middle interior passage 334. According to some embodiments, a lower-middle locking mechanism 338 may be coupled to the middle shaft 332 at or adjacent to the lower-middle opening 336*b*. The lower-middle locking mechanism 338 may, for example, be operable to be selectively engaged to compress and/or otherwise secure or fix the second or bottom end of the middle shaft 332 and/or the second or lower-middle opening 336*b*.

In some embodiments, the multi-segment weighted trekking pole system 300 may comprise a lower segment 370. The lower segment 370 may comprise, for example a lower shaft 372 that may comprise a solid (or hollow) carbon-fiber, aluminum, or steel rod. In some embodiments, the lower shaft 372 and/or the lower segment 370 may comprise a first or lower "male" end 374 at a top end thereof and/or one or more engaging elements 376*a-b* at a bottom end thereof. The engaging elements 376*a-b* may comprise, for example, a ground-engaging tip 376*a* and/or a protector or foot 376*b*. The tip 376*a* may comprise a tungsten carbide tip for engaging with ground elements such as dirt, rocks, tree roots, etc. The foot 376*b* may, in some embodiments, couple to and/or accept the tip 376*a* such as by an interference fit and/or a threaded coupling (not explicitly shown), e.g., for more secure coupling of the tip 376*a* and the foot 376*b*. The foot 376*b* may comprise a plastic, rubber, and/or metal element for engaging with hard surfaces such as floors, sidewalks, roads, etc. According to some embodiments, the foot 376*b* may comprise and/or house a steel disk or annular insert 376*b*-1 to prevent the tip 376*a* from puncturing through the softer material of the foot 376*b* and/or to protect the tip 376*a* by providing a hole and/or seat that cushions and/or guides the tip 376*a* when inserted into the foot 376*b*. In some embodiments, the lower segment 370 may comprise and/or be coupled to a basket 378. The basket 378 may comprise, for example, a plastic or metal radially flared element for enhancing stability and/or reducing penetration distance into soft materials such as sand or snow. In some embodiments, such as in the case that the lower segment 370 comprises a solid stainless steel rod or element, the basket 378 may comprise a feature and/or protrusion integral to the rod (e.g., formed and/or extruded therefrom).

According to some embodiments, the multi-segment weighted trekking pole system 300 may comprise a weight adapter or lock 340 and/or a plurality of weights 362*a-b*. The weight lock 340 and the weights 362*a-b* may, for example, comprise annular elements that slide onto the lower shaft 372. The weight lock 340 may, in some embodiments, comprise a metal, rubber, and/or plastic element having a taper that nests inside of a bottom or second one of the weights 362*b*. According to some embodiments, the tapered and/or weight-engaging portion of the weight lock 340 (e.g., a portion that slides into the bore of the second weight 362*b*) may be pliable such that the second weight 362*b* resting thereupon, in the case that the weight lock 340 is sleeved over the lower shaft 372, may urge or squeeze the pliable tapered portion inward, increasing inward radial force applied by the weight lock 340 on the sides of the lower shaft 372. The weights 362*a-b* acting upon the weight lock 340 may, for example, cause the weight lock 340 to squeeze the lower shaft 372, e.g., causing an engagement that prevents the weight lock 340 (and the attendant weights 362*a-b*) from sliding down the lower shaft 372. In such a manner, for example, the weight lock 340 may support the weights 362*a-b* and prevent the weights 362*a-b* from exerting undue force upon the basket 378. In some embodiments, an additional weight lock (not shown) may be coupled above the weights 362*a-b*, such as to prevent upward movement of the weights 362*a-b* during use and/or transport of the multi-segment weighted trekking pole system 300.

According to some embodiments, the weights 362*a-b* may comprise cylindrical bladder elements having and/or defining interior volumes capable of storing liquids and internal bores 362*a*-1, 362*b*-1 through which the outside diameter of the lower shaft 372 may freely pass. According to some embodiments, the weights 362*a-b* may be constructed of plastic, rubber, stainless steel, and/or aluminum and/or may be filled with various desirable weight-bearing substances. The weights 362*a-b* may be filled with sand, concrete, rocks, and/or other solid or granular substances, for example, and/or may be filled with water, glycol, and/or other liquids. The weights 362*a-b* may, for example, comprise water bottles that comprises a valve, nipple, spout, and/or other feature 362*a*-2, 362*b*-2 that permits water (and/or other substances) to be disposed within and/or removed from the interior volumes or bladders, as desired. The weights 362*a-b* may, in the case they are constructed of plastic for example, be either rigid (e.g., a bisphenol-free plastic or co-polyester such as Tritan® available from Eastman Chemical Company of Kingsport, Tenn.) or collapsible (e.g., food-grade polyethylene and/or nylon).

In some embodiments, additional weights (not shown) may be utilized until at least approximately three inches (3") or seven and sixty-two hundredths centimeters (7.62 cm) of the lower male end 374 of the lower shaft 372 remains extending above/beyond the mounted weights 362*a-b* (and/or additional upper weight lock), e.g., to provide for at least three inches (3") or seven and sixty-two hundredths centimeters (7.62 cm) of "male" insertion distance into the middle interior passage 334 of the middle shaft 332, such as to permit an adequately strong coupling of the lower portion 370 and the middle portion 330.

According to some embodiments, the assembly of the multi-segment weighted trekking pole system 300 may be as depicted in FIG. 3B. The lower male end 374 of the lower shaft 372 may define and/or comprise an outside diameter that is smaller than an inside diameter of the weight lock 340, for example, and may be inserted into and/or nested therein. The lower male end 374 of the lower shaft 372 may also or alternatively define and/or comprise an outside diameter that is smaller than an inside diameter of the internal bores 362*a*-1, 362*b*-1 of the weights 362*a-b*, and may be inserted there through. In some embodiments, the lower male end 374 of the lower shaft 372 (e.g., with weight lock 340 and/or water-bottle weights 362*a-b* installed thereon) may define and/or comprise an outside diameter that is smaller than an inside diameter of the middle interior passage 334 of the middle shaft 332 and may be inserted into and/or nested therein.

The lower male end 374 may be inserted into the lower-middle opening 336*b* of the middle shaft 332, for example, and selectively secured in place at a desired level of insertion by engagement and/or activation of the lower-middle locking mechanism 338. Similarly, the first end 336*a* of the middle shaft 332 may define and/or comprise an outside diameter that is smaller than the inside diameter of the upper interior passage 314 of the upper shaft 312 and may be inserted into and/or nested therein. The first end 336*a* may be inserted into the upper opening 316 of the upper shaft 312, for example, and selectively secured in place at a desired level of insertion (e.g., by at least three inches (3") or seven and sixty-two hundredths centimeters (7.62 cm), such as to permit an adequately strong coupling) by engagement and/or activation of the upper locking mechanism 318. According to some embodiments, the lower male end 374 and/or the first end 336*a* may comprise and/or be coupled to an end protector (not shown) such as a plastic or rubber tip, e.g., to reduce and/or prevent damage from abutment or collision of the lower male end 374 with the lower-middle opening 336*b* (e.g., within the middle interior passage 334) and/or to reduce and/or prevent damage from abutment or collision of the first end 336*a* with the upper opening 316 (e.g., within the upper interior passage 314).

In some embodiments, any desired quantity and/or mass or size of water-bottle weights 362*a-b* and/or the weight lock 340 may be inserted onto the lower shaft 372, e.g., from the lower male end 374 thereof. In such a manner, for example, the multi-segment weighted trekking pole system 300 may be outfitted with a variable amount of weight (e.g., the weights 362*a-b*) between the middle segment 330 and the engaging elements 376*a-b*, permitting not only enhanced fitness capabilities that are less likely to result in injury (e.g., wrist straining) but also providing for quick and easy change-over to different weight levels, as desired. According to some embodiments, such as described in detail with respect to FIG. 2A and FIG. 2B herein, the weights 362*a-b* and/or the weight lock 340 may also or alternatively be utilized on the middle shaft 332.

The multi-segment weighted trekking pole system 300 is described as a "trekking pole" for purposes of illustration and ease of description. While in some embodiments the multi-segment weighted trekking pole system 300 may be constructed and/or utilized for hiking, trekking, walking, and/or "Nordic-style" walking (and/or running), the multi-segment weighted trekking pole system 300 may also or alternatively be constructed and/or utilized for skiing, exercising, and/or other activities that are or become practicable. While one style of clamp is depicted with respect to the locking mechanisms 318, 338, different types and/or styles of locking mechanisms 318, 338 may be utilized in some embodiments, as is or becomes known or practicable. According to some embodiments, larger locking mechanisms 318, 338 and/or additional (e.g., paired) locking mechanisms 318, 338 may be utilized, e.g., to maintain retention and/or coupling abilities under additional strain placed on the multi-segment weighted trekking pole system 300 and/or between the segments 310, 330, 370 thereof due to the added weights 362*a-b*.

In some embodiments, any or all of the components 310, 312, 314, 316, 318, 320, 322, 330, 332, 334, 336*a-b*, 338, 340, 362*a-b*, 362*a*-1, 362*b*-1, 362*a*-2, 362*b*-2, 370, 372, 374, 376*a-b*, 378 of the multi-segment weighted trekking pole system 300 may be similar in configuration and/or functionality to any similarly named and/or numbered components described herein. Fewer or more components 310, 312, 314, 316, 318, 320, 322, 330, 332, 334, 336*a-b*, 338, 340, 362*a-b*, 362*a*-1, 362*b*-1, 362*a*-2, 362*b*-2, 370, 372, 374, 376*a-b*, 378 (and/or portions thereof) and/or various configurations of the components 310, 312, 314, 316, 318, 320, 322, 330, 332, 334, 336*a-b*, 338, 340, 362*a-b*, 362*a*-1, 362*b*-1, 362*a*-2, 362*b*-2, 370, 372, 374, 376*a-b*, 378 may be included in the multi-segment weighted trekking pole system 300 without deviating from the scope of embodiments described herein. In some embodiments, one or more of the various components 310, 312, 314, 316, 318, 320, 322, 330, 332, 334, 336*a-b*, 338, 340, 362*a-b*, 362*a*-1, 362*b*-1, 362*a*-2, 362*b*-2, 370, 372, 374, 376*a-b*, 378 may not be needed and/or desired in the multi-segment weighted trekking pole system 300.

IV. Weight Locks

Referring now to FIG. 4A, FIG. 4B, FIG. 4C, and FIG. 4D, left-front perspective, top, bottom, and front views of a weight lock 440 according to some embodiments are shown. The weight lock 440 may comprise, for example, a tubular portion 442 extending along an axis "A-A" and/or an annular base portion 444 coupled and/or formed to the tubular portion 442 at one end thereof. In some embodiments, the tubular portion 442 and/or the annular base portion 444 may comprise and/or define an interior bore 446 extending along the axis "A-A", as depicted. According to some embodiments, the interior bore 446 may be sized (e.g., have an appropriate diameter) to fit over a shaft of a trekking (and/or other) pole (not shown). In some embodiments, multiple weight locks 440 with different sized interior bores 446 may be provided to fit on different diameter poles, shafts, and/or pole segments. In some embodiments, the weight lock 440 and/or the tubular portion 442 thereof may be constructed of metal, rubber, plastic, and/or other durable materials as desired. In some embodiments, the interior bore 446 may be defined by a removable portion or insert of the weight lock 440 such that different inserts defining different diameters of the interior bore 446 may be selectively engaged with the weight lock 440 so that the weight lock 440 may be selectively re-sized to fit on different diameter poles, shafts, etc. According to some embodiments, the weight lock 440 and/or the tubular portion 442 may be constructed at least partially of a pliable material such as rubber, foam, or plastic, at least through the interior bore 446 (e.g., where the weight lock 440 may be removably coupled to a pole or shaft (not shown)). In some embodiments, the weight lock 440 and/or the tubular portion 442 thereof may comprise and/or define a plurality of pliable arms 448*a-d* (e.g., fastening elements) extending from the annular base portion 444 and along the axis "A-A" (e.g., axially). The tubular portion 442 may, for example, be cut, split, and/or formed with a plurality of channels extending from an outside surface thereof to the interior bore 446, thereby defining the plurality of arms 448*a-d*. As depicted, the plurality of arms 448*a-d* may be coupled to the annular base portion 444 at first ends thereof, extend from the annular base portion 444 and first ends along the axis "A-A", and be free at second, distal ends thereof. The plurality of arms 448*a-d* may accordingly, in accordance with some embodiments, be cantilevered such that radially inward force applied to any one arm 448*a-d* of the plurality of arms 448*a-d* may cause such arm 448*a-d* to deflect radially inwardly. Such a radially inward deflection may generally cause a decrease in diameter of the interior bore 446, which in-turn may apply inward radial pressure on any object disposed in or through the interior bore (e.g., a shaft of a pole).

According to some embodiments, the tubular portion 442 and/or the plurality of arms 448*a-d* may comprise a taper (linear, parabolic, spiral, flared, stepped, or otherwise) such that a first exterior diameter of the tubular portion 442 and/or the plurality of arms 448*a-d* at the first or proximate (to the annular base portion 444) end may be larger than a second exterior diameter of the tubular portion 442 and/or the plurality of arms 448*a-d* at the second or distal end. In some embodiments, a weight, clasp, and/or other element may exert force upon the exterior surface of the tubular portion 442 and/or the plurality of arms 448*a-d* such that at least one of the plurality of arms 448*a-d* is deflected radially inward. According to some embodiments, an annular weight (not shown) having an interior passage may slide over the tubular portion 442 and/or the plurality of arms 448*a-d* and engage with the taper to apply radially inward force to the plurality of arms 448*a-d*. The second exterior diameter of the tubular portion 442 and/or the plurality of arms 448*a-d* at the second or distal end may be sized to fit within or through the interior passage of such an annular weight, for example, while the larger first exterior diameter of the tubular portion 442 and/or the plurality of arms 448*a-d* at the first or proximate end may be equal to or larger than the interior diameter of the interior passage, causing an interference between the weight lock 440 and the weight which causes an urging of the plurality of arms 448*a-d* (at least one of the plurality of arms 448*a-d*) in a radially inward direction. In such a manner, for example, engagement of an annular weight with the weight lock 440 on a pole or shaft segment (not shown) may cause the weight lock 440 to compress inwardly against the pole and accordingly prevent axial movement of the weight and/or weight lock 440 along the shaft.

While the plurality of arms 448*a-d* have been depicted and described as comprising fastening elements that may be utilized to selectively engage the weight lock 440 with a shaft or pole disposed in or through the interior bore 446, other types and/or quantities of fastening elements may be utilized in some embodiments. Similarly, while the weight lock 440 is described as being a stand-alone object, in some embodiments it may be incorporated into and/or be part of another object such as an annular weight, water bottle, etc.

In some embodiments, any or all of the components 442, 444, 446, 448*a-d* of the weight lock 440 may be similar in configuration and/or functionality to any similarly named and/or numbered components described herein. Fewer or more components 442, 444, 446, 448*a-d* (and/or portions thereof) and/or various configurations of the components 442, 444, 446, 448*a-d* may be included in the weight lock 440 without deviating from the scope of embodiments described herein. In some embodiments, one or more of the various components 442, 444, 446, 448*a-d* may not be needed and/or desired in the weight lock 440.

V. Weights

Figure 5:
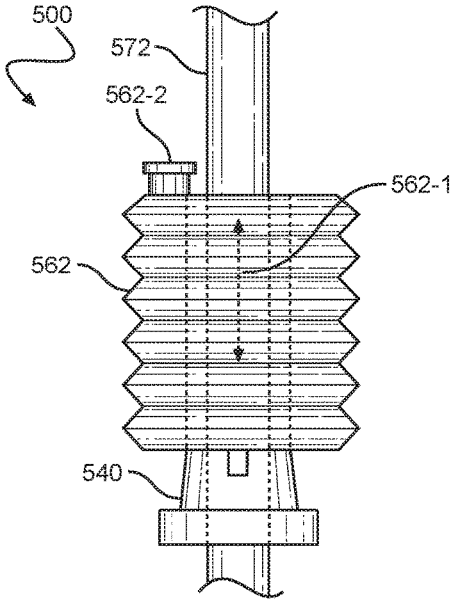
FIG. 5 is a partial front view of a weighted trekking pole system according to some embodiments.

Turning now to FIG. 5, a partial front view of a weighted trekking pole system 500 according to some embodiments is shown. In some embodiments, the weighted trekking pole system 500 may comprise a weight lock 540 and a collapsible water bottle weight 562 (e.g., comprising an interior passage 562-1 and a spout 562-2) disposed on a shaft 572 (only a portion of which is depicted in FIG. 5, for ease of illustration). The collapsible water bottle weight 562 may, for example, be filled with water (or another consumable liquid; e.g., via the spout 562-2) and slid onto the shaft 572 via the interior passage 562-1. According to some embodiments, the weight of the collapsible water bottle weight 562 and attendant liquid may act downwardly upon the weight lock 540 such that the interior walls of the interior passage 562-1 apply radially inward pressure to the exterior walls of the weight lock 540. In the case that the weight lock 540 is compressible and/or pliable, such radially inward pressure may be passed inwardly to the shaft 572 such that the weight lock 540 is selectively and unmovably coupled to the shaft 572. The engagement of the collapsible water bottle weight 562 with the weight lock 540 may, for example, prevent the collapsible water bottle weight 562 (and the weight lock 540) from sliding any further downward along the shaft 572. This coupling can be particularly desirable in the case that elements (not shown) further downward along the shaft 572 are not capable of and/or are not desired to bear the weight of the collapsible water bottle weight 562 and attendant liquid therein. In some embodiments, multiple collapsible water bottle weights 562 and/or other style weights such as annular cast-iron weights may be added to and/or stacked in the weighted trekking pole system 500 such that the total weight (and/or liquid carrying capacity) of the weighted trekking pole system 500 may be adjusted as-desired.

In some embodiments, any or all of the components 540, 562, 562-1, 562-2, 572 of the weighted trekking pole system 500 may be similar in configuration and/or functionality to any similarly named and/or numbered components described herein. Fewer or more components 540, 562, 562-1, 562-2, 572 (and/or portions thereof) and/or various configurations of the components 540, 562, 562-1, 562-2, 572 may be included in the weighted trekking pole system 500 without deviating from the scope of embodiments described herein. In some embodiments, one or more of the various components 540, 562, 562-1, 562-2, 572 may not be needed and/or desired in the weighted trekking pole system 500.

Figure 6:
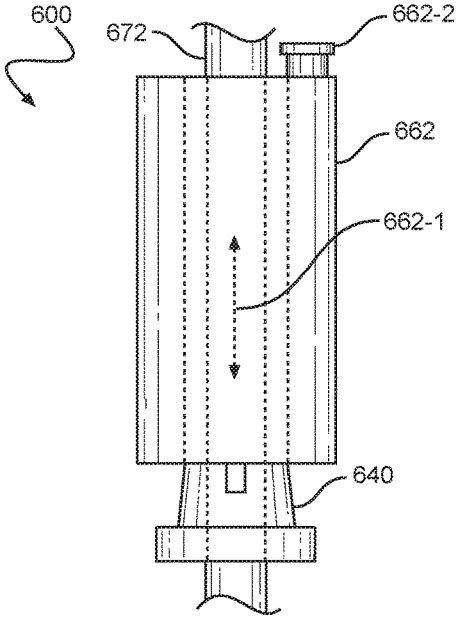
FIG. 6 is a partial front view of a weighted trekking pole system according to some embodiments.

Referring to FIG. 6, a partial front view of a weighted trekking pole system 600 according to some embodiments is shown. In some embodiments, the weighted trekking pole system 600 may comprise a weight lock 640 and a cylindrical water bottle weight 662 (e.g., comprising an interior passage 662-1 and a spout 662-2) disposed on a shaft 672 (only a portion of which is depicted in FIG. 6, for ease of illustration). The cylindrical water bottle weight 662 may, for example, be filled with water (or another consumable liquid; e.g., via the spout 662-2) and slid onto the shaft 672 via the interior passage 662-1. According to some embodiments, the weight of the cylindrical water bottle weight 662 and attendant liquid may act downwardly upon the weight lock 640 such that the interior walls of the interior passage 662-1 apply radially inward pressure to the exterior walls of the weight lock 640. In the case that the weight lock 640 is compressible and/or pliable, such radially inward pressure may be passed inwardly to the shaft 672 such that the weight lock 640 is selectively and unmovably coupled to the shaft 672. The engagement of the cylindrical water bottle weight 662 with the weight lock 640 may, for example, prevent the cylindrical water bottle weight 662 (and the weight lock 640) from sliding any further downward along the shaft 672. This coupling can be particularly desirable in the case that elements (not shown) further downward along the shaft 672 are not capable of and/or are not desired to bear the weight of the cylindrical water bottle weight 662 and attendant liquid therein. In some embodiments, multiple cylindrical water bottle weights 662 and/or other style weights such as annular cast-iron weights may be added to and/or stacked in the weighted trekking pole system 600 such that the total weight (and/or liquid carrying capacity) of the weighted trekking pole system 600 may be adjusted as-desired In some embodiments, any or all of the components 640, 662, 662-1, 662-2, 672 of the weighted trekking pole system 600 may be similar in configuration and/or functionality to any similarly named and/or numbered components described herein. Fewer or more components 640, 662, 662-1, 662-2, 672 (and/or portions thereof) and/or various configurations of the components 640, 662, 662-1, 662-2, 672 may be included in the weighted trekking pole system 600 without deviating from the scope of embodiments described herein. In some embodiments, one or more of the various components 640, 662, 662-1, 662-2, 672 may not be needed and/or desired in the weighted trekking pole system 600.

Figure 7:
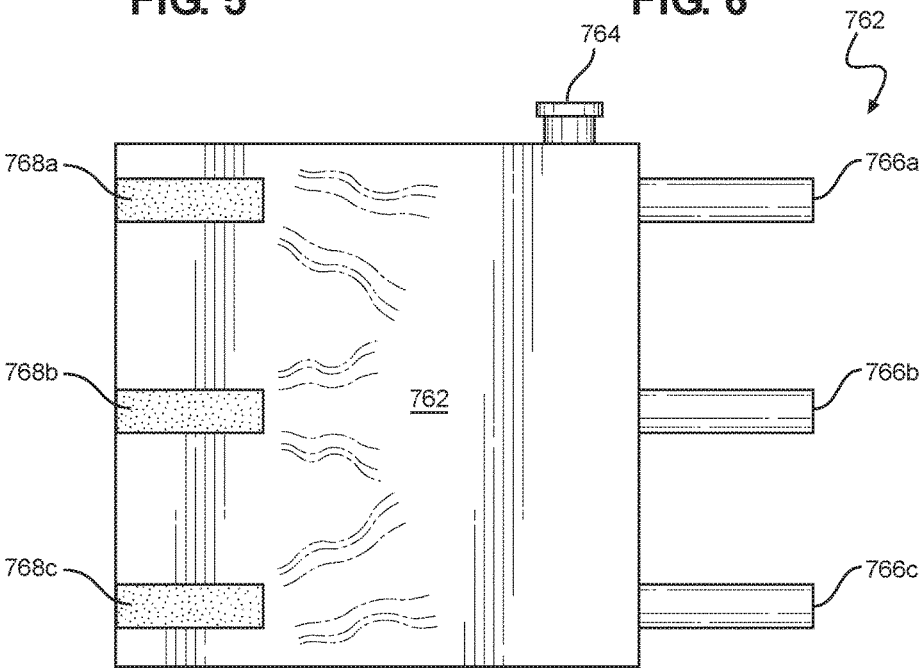
FIG. 7 is a front view of a trekking pole weight bladder according to some embodiments.

Turning now to FIG. 7, a front view of a trekking pole weight bladder 762 according to some embodiments is shown. The trekking pole weight bladder 762 may comprise, for example, a bladder body 762-1 that is fillable and/or may be emptied via a spout 764. The trekking pole weight bladder 762 may be filled with water and/or other consumable liquid, for example. In some embodiments, the trekking pole weight bladder 762 may comprise a plurality of straps 766*a-c* arranged along a first edge of the bladder body 762-1 to engage and couple with a plurality of fasteners 768*a-c* arranged along a second and/or opposing edge of the bladder body 762-1. In the case that the trekking pole weight bladder 762 is folded around a pole, shaft, or other cylindrical object (not shown), for example, the plurality of straps 766*a-c* may be positioned to engage and couple with the plurality of fasteners 768*a-c*. According to some embodiments plurality of straps 766*a-c* and the plurality of fasteners 768*a-c* may comprise paired hook-and-loop or hook-and-pile fastener (e.g., such as is available from Velcro® USA, Inc. of Manchester, N.H.) portions and/or other mating fastener portions such as buttons and button holes, snaps, magnets, etc. In some embodiments, the surface of the trekking pole weight bladder 762 may comprise and/or be constructed of a hook-and-loop/hook-and-pile material such that the plurality of straps 766*a-c* may engage directly with the surface, such that the plurality of fasteners 768*a-c* are not separately required to achieve a closed wrapping of the trekking pole weight bladder 762.

In some embodiments, any or all of the components 762-1, 764, 766*a-c*, 768*a-c* of the trekking pole weight bladder 762 may be similar in configuration and/or functionality to any similarly named and/or numbered components described herein. Fewer or more components 762-1, 764, 766*a-c*, 768*a-c* (and/or portions thereof) and/or various configurations of the components 762-1, 764, 766*a-c*, 768*a-c* may be included in the trekking pole weight bladder 762 without deviating from the scope of embodiments described herein. In some embodiments, one or more of the various components 762-1, 764, 766*a-c*, 768*a-c* may not be needed and/or desired in the trekking pole weight bladder 762.

Some embodiments herein may be associated with the term "approximately". As utilized herein, the term approximately generally refers to either a specifically-recited numerical value or a range of values that fall between plus or minus ten percent (10%) of the recited value. In the case that a particular value is recited without the qualifier of "approximately", it should be understood that, unless specifically limited, equivalents to such value are also contemplated and generally fall between plus or minus five percent (5%) of the recited value. Although specific quantities, values, and/or measurements are presented herein for purposes of example and ease of explanation, such quantities, values, and/or measurements are not limiting and equivalent, approximate, and/or different quantities, values, and/or measurements may be utilized without deviating from the scope of some embodiments.

The present disclosure provides, to one of ordinary skill in the art, an enabling description of several embodiments and/or inventions. Some of these embodiments and/or inventions may not be claimed in the present application, but may nevertheless be claimed in one or more continuing applications that claim the benefit of priority of the present application. Applicant currently intends to file additional applications to pursue patents for subject matter that has been disclosed and enabled but not claimed in the present application.

What is claimed is:

1. A multi-segment trekking pole, comprising:

an upper segment comprising a first end and a second end, the second end comprising a female mating portion;

a handle portion coupled to the first end of the upper segment;

a bottom segment comprising a first end and a second end, the first end comprising a ground-engaging portion and the second end comprising a male mating portion;

a middle segment comprising a first end and a second end, the first end comprising a male mating portion operable to selectively couple to the second end of the upper segment, and the second end comprising a female mating portion operable to selectively couple to the second end of the bottom segment;

a weight lock defining an interior bore through which one of the middle segment and the bottom segment is disposed and at least one fastening element operable to prevent sliding of the weight lock along the one of the middle segment and the bottom segment; and at least one annular and removable weight defining an interior passage through which the one of the middle segment and the bottom segment is disposed, wherein the at least one annular and removable weight comprises a water bottle.

2. The multi-segment trekking pole of claim 1, wherein the at least one annular and removable weight rests upon the weight lock.

3. The multi-segment trekking pole of claim 1, wherein the at least one annular and removable weight engages with the fastening element of the weight lock.

4. The multi-segment trekking pole of claim 3, wherein the at least one annular and removable weight causes the fastening element of the weight lock to tighten inwardly against the one of the middle segment and the bottom segment.

5. The multi-segment trekking pole of claim 1, wherein the at least one annular and removable weight comprises at least one of a valve, a nipple, and a spout.

6. The multi-segment trekking pole of claim 1, wherein the fastening element comprises a plurality of pliable arms having an exterior taper that causes an inward radial compression of the weight lock when acted upon by the at least one annular and removable weight.

7. The multi-segment trekking pole of claim 1, wherein the ground-engaging portion comprises a combined foot and basket element threaded onto the first end of the bottom segment.

* * * * *